US005158282A

United States Patent [19]

Winter

[11] Patent Number: 5,158,282

[45] Date of Patent: Oct. 27, 1992

[54] LINE MARKERS FOR TENNIS COURTS AND THE LIKE

[76] Inventor: Cyril D. Winter, 348 Zephyr Ave., Apt #22, Ottawa, Ontario, Canada, K2B 6A1

[21] Appl. No.: 694,074

[22] Filed: May 1, 1991

[51] Int. Cl.[5] ..... A63C 19/06

[52] U.S. Cl. ..... 273/31

[58] Field of Search ..... 273/31, 25; 272/3, 56.5 SS; 404/12, 11, 13, 14; 403/292

[56] References Cited

U.S. PATENT DOCUMENTS

| | | | |
|---|---|---|---|
| 1,728,275 | 9/1929 | Herman et al. | 404/12 |
| 1,928,447 | 9/1933 | Cornell, Jr. | 404/12 |
| 1,961,580 | 6/1934 | Brown | 404/12 |
| 1,986,941 | 1/1935 | Pearson | 273/31 |
| 2,685,140 | 8/1954 | Nedwick | 273/55 R |
| 4,429,872 | 2/1984 | Capachi | 272/3 |

FOREIGN PATENT DOCUMENTS

| | | | |
|---|---|---|---|
| 216182 | 5/1924 | United Kingdom | 404/12 |
| 650674 | 2/1951 | United Kingdom | 404/12 |
| 2150036 | 6/1985 | United Kingdom | 272/3 |

*Primary Examiner*—Theatrice Brown

*Attorney, Agent, or Firm*—Charles P. Boukus, Jr.

[57] ABSTRACT

Disclosed is a line marker for tennis courts and the like and particularly for clay courts. The line marker consists of a generally T-shaped strip of material of predetermined color and length. The T-shaped material has a vertical portion and a horizontal portion, the vertical portion being of a continuous length of material whereas the horizontal portion comprises a plurality of spaced laterally extending elements. Preferably the horizontal portion is made with alternate spaced elements, these elements being formed by cutting laterally about half way into a strip of material and alternately folding the elements at 90° to form the horizontal portion, the remaining part of the strip forming the vertical portion.

3 Claims, 2 Drawing Sheets

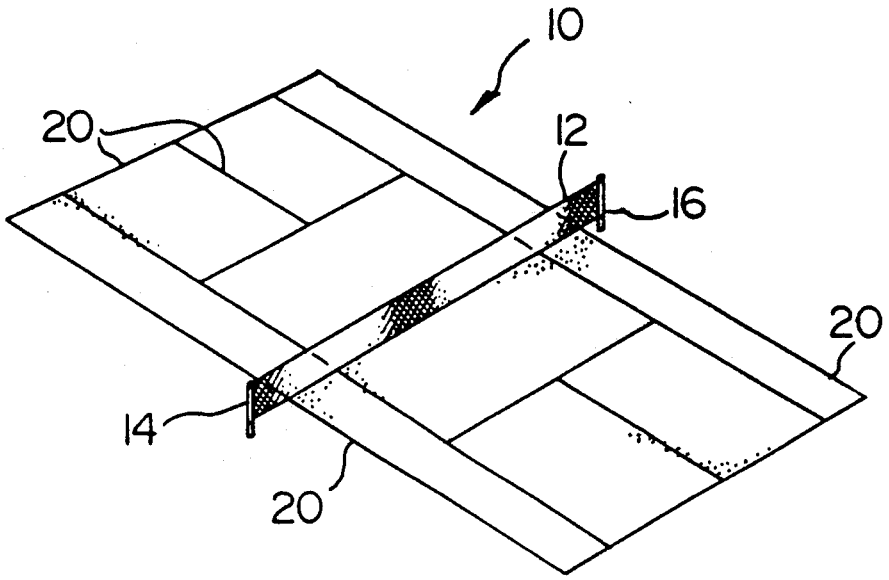
FIG.1
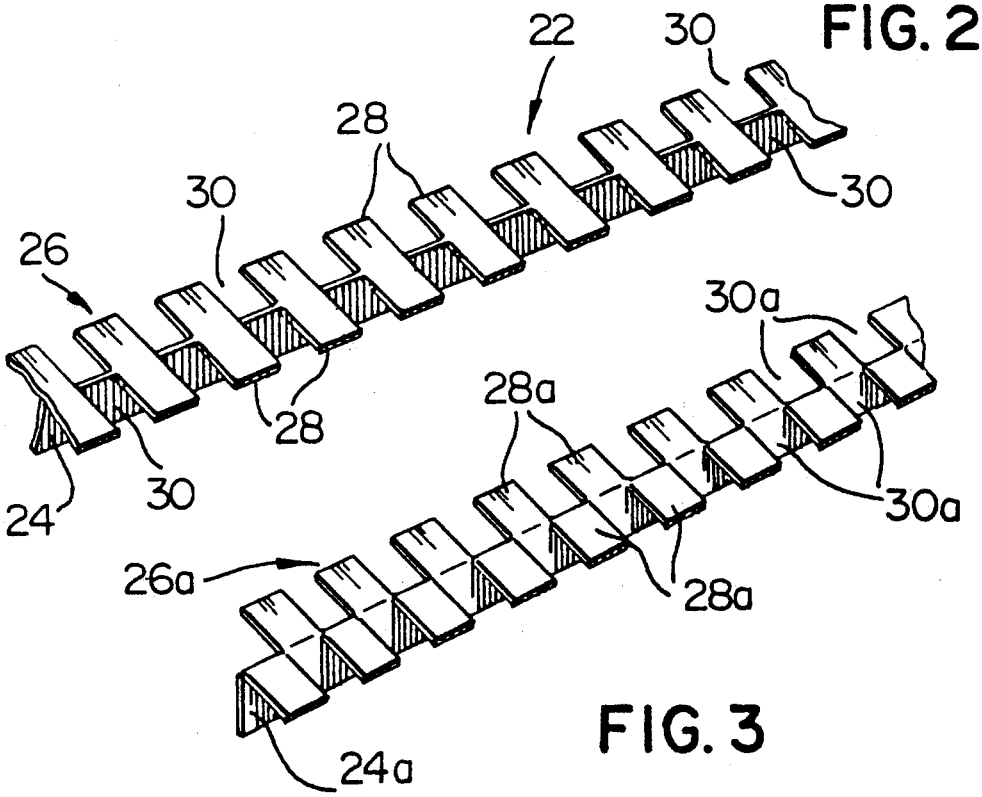
FIG. 2
FIG. 3

LINE MARKERS FOR TENNIS COURTS AND THE LIKE

FIELD OF THE INVENTION

This invention relates to line marking means for outdoor tennis courts and the like, and more particularly for outdoor "clay" tennis courts.

BACKGROUND OF THE INVENTION

Tennis is one of the most active non-professional sports in which the general populace participate in with varying degrees of enthusiasm. Tennis courts for such people come in a wide range of constructional qualities, but by and large they are most common as asphalt court, artificial turf court, and clay court. By its very nature, clay courts are among the more difficult to maintain including maintaining line and side line markings. Various attempts have been made to use chalk or the like, but it is easily erased with the repeated sliding action of the feet of the players. Solid strips of plastic material "nailed" down to the clay are now commonly used, the fasteners and nails being spaced about three inches apart. These solid plastic line markings have proved effective to a degree, but they have disadvantages in that they are often slippery, particularly if damp. Balls which hit the line are often significantly affected by the inherent slippery characteristic of these solid lines. Further, proper tennis shoes also slip on the line markings. Roughening the surface of these solid plastic line markers has attempted to reduce the slip. Further, the strip spacially nailed down suffers when clay material is pushed under or gets under the strip at various locations, warping or causing the line marker to "wave" in spots.

Accordingly, there is a need for a new improved line marking means which reduces further the slippage of ball and foot, and which is easily installed and to be removed to facilitate court maintenance.

SUMMARY OF THE INVENTION

The invention seeks to provide a line marker for tennis courts and the like and particularly for clay courts which effectively reduces the chance of ball or foot slippage, is effectively anchored to the court, and yet may be easily installed and removed.

The invention provides a line marker comprising a generally T-shaped strip of material of predetermined color and length which has a generally vertical first portion and a horizontal second portion integral with the first portion, the first portion being of substantially continuous longitudinal extending material, and the second portion comprising a plurality of longitudinally spaced elements extending laterally from the first portion.

In one embodiment, the second portion elements are spaced opposed to each other, whereas in a more preferred embodiment, the second portion elements on one side of the plane of the first portion are spaced alternatively with respect to those on the other side thereof.

In installing the new line markers, a groove is formed in the clay at the proper location and to a depth to accommodate the vertical first portion. The first portion is pushed into the groove by hand so that the horizontal second portion rests on the surface of the clay. Then clay particulates may be used to fill in the spaces.

Because of the spaced elements, I have found that the plastic line marker has significantly reduced slippage for both a ball which hits the line and a foot. The still spaced elements provide ample line marking and indeed from an angle looks like a solid line.

No nailing of the lines is necessary, and the line may be removed relatively easily. Although spaced holes in the vertical or first portion may enhance the gripping thereof by the clay once installed and the clay permeates within the holes, I have found this is not necessary. It also makes its slightly more difficult to remove the line markings.

Other features and advantages of the invention will become apparent from the detailed description of the invention provided herein.

BRIEF DESCRIPTION OF THE DRAWINGS

FIG. 1 is a schematic perspective view of a tennis court;

FIG. 2 is a perspective of one embodiment of my invention;

FIG. 3 is a perspective view of a second embodiment of my invention;

DETAILED DESCRIPTION OF THE INVENTION

Figure 4:
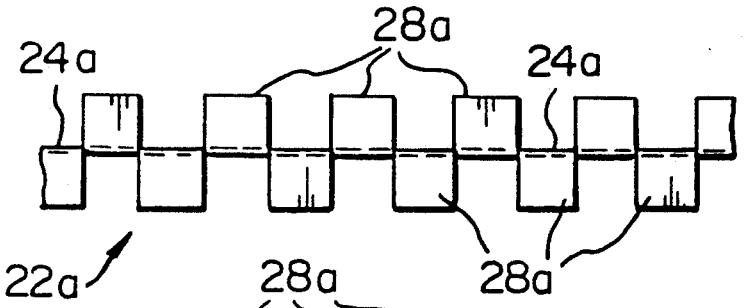
FIG. 4 is a top view of the embodiment of FIG. 3.
Figure 5:
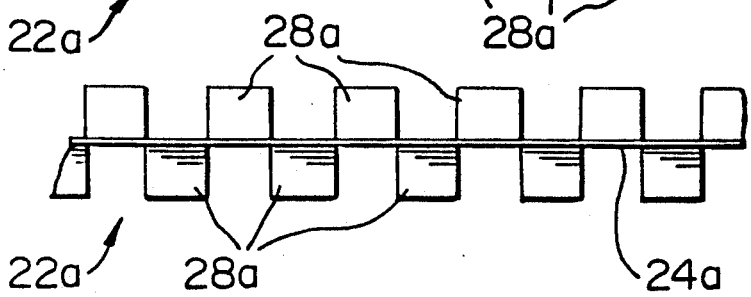
FIG. 5 is a bottom view of the embodiment of FIG. 3.
Figure 6:
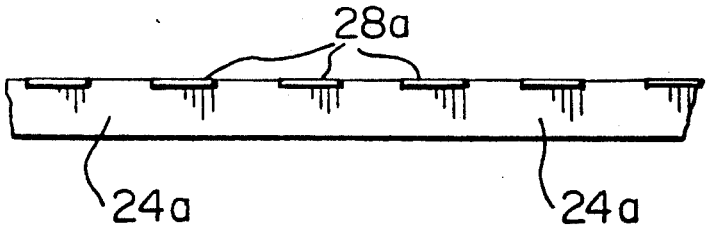
FIG. 6 is a side view of the embodiment of FIG. 3.
Figure 7:
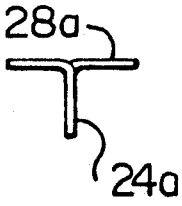
FIG. 7 is an end view of the embodiment of FIG. 3.

FIG. 1 illustrates schematically a tennis court 10 with net 12 supported by posts 14 and 16. Line markings 20 define the size of the court according to the rules of play.

Depending on the constructional nature of the surface of the tennis court 10, lines 20 may be painted on such as when the court is of aspalt, or otherwise of material imbedded in or painted on the surface when of artificial turf. With clay based courts, the line markings are today most often a strip of solid plastic nailed or otherwise fastened at intervals, such as three inches, to the clay surface.

With respect to my invention, which in one embodiment is shown in FIG. 2, I provide a generally T-shaped strip 22 of predetermined length and preferably of a plastic material such as PVC (poly vinyl chloride). Strip 22 has a vertical or first portion 24 which is generally solid throughout its length, although it may have spaced holes or the like as set forth further herein.

Strip 22 also has a horizontal or second portion 26 made up of elements 28 each integral with first portion 25. Elements 28 are spaced from each other by spaces 30 and elements 28 extend on opposite sides of the plane of first portion 24. In fabricating strip 24, a solid extruded T-shaped piece of plastic (such as PVC) is worked such as to cut spaces 30 in the horizontal or second portion 26 by known technology.

Figure 8:
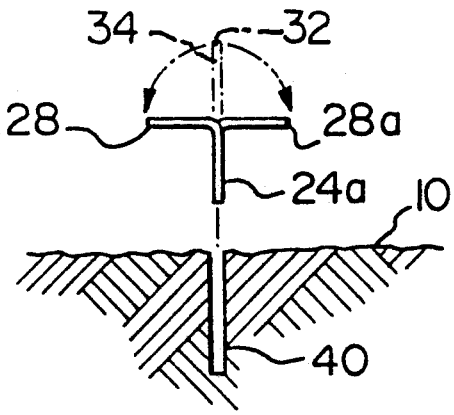
FIG. 8 is an end view of the line marker showing how it is made from one strip with bent alternative horizontal elements and its insertion into a groove in the court surface.

Turning now to FIGS. 3–7 (where like features have an "a" notation). there is shown a preferred form of my invention wherein the horizontal portion **26*a* has a plurality of elements 28*a* alternating on one side of the plane of first portion 24 with spaces 30*a*** on the other side thereof. The fabrication of the embodiment is easier, since all that is required is to take a single flat strip 32 of appropriate size, (see FIG. 8 dotted line), cut lines 34 and then bend or fold alternating elements 28*a* (dotted line) from the plane of the piece 32 to form the horizontal portions 26*a*.

It will be appreciated however that the strip 22*a* may be formed from an extruded T-shape strip with alternating spaces cut out.

In installing the strip 22 and 22*a*, vertical groove 40 is cut in the surface of the court 10 at appropriate locations and a vertical first portion 24*a* pushed into the groove 40 by hand, foot or roller (not shown).

Groove 40 may be hand-cut against a guide board or the like (not shown) or may be cut by a rotary blade of the kind used to cut cinder blocks, asphalt or concrete.

Once installed, line marker strips 22, 22*a* will properly define the course and yet because of the construction reduce the slippage of ball and foot coming in contact therewith. The spaces 30 will fill up naturally with loose clay and tend to level to the top of the strip. Grading along the sides of the strip may also be performed as considered desired or necessary.

By way of further illustration of the preferred embodiment, the plastic should be relatively rigid and the thickness preferred is 2 mm (about 0.08 inch). The depth of the first portion 24 (24*a*) is 2.5 cm (about 1 inch) and the width of the second portion 26 (26*a*) from side edge to side edge is about 5.0 cm (about 2 inch). Preferably the width of the spacing and width of the elements are uniform, and they can be from 1 cm (about 0.4 inch) to 2 cm (about 0.8 inch).

Also, the vertical portion of the strip 22 may have holes or other apertures or upwardly directed laterally extending tines punched out of said portion to enhance the grip between the strip and the clay after installation.

Accordingly, I have provided a new and improved line marker, for tennis courts and the like which are of a surface such as clay which may be easily grooved to accommodate the marker device.

I claim:

1. A tennis court line marker comprising a flexible T-shaped strip of predetermined length having a ground insertion vertical portion and a horizontal portion, the horizontal portion being comprised of plurality of longitudinally spaced elements, each element extending longitudinally and laterally of the plane of the vertical portion, the elements extending on each side of the plane of the vertical portion and being alternately opposite a space, and said strip comprising a single piece of plastic material wherein the horizontal portion elements are defined by cuts inwardly from one edge of such portion and bent on either side of the plane of said vertical portion.

2. The method of providing line markings on a tennis court comprising:

providing a line marker as defined in claim 1, forming a single vertical groove in the surface of a tennis court at predetermined locations; and forcing the vertical portion of said marker into said groove whereby the horizontal portion will lie flat on the surface.

3. The method of making the marker of claim 1, comprising:

providing a strip of plastic material of predetermined length and having a plane;

making parallel cuts at selected locations along the length of said strip inwardly from one edge thereof for a predetermined distance to define a plurality of elements; and bending alternative elements defined by said cuts to a position substantially perpendicular to one side of the plane of said strip and the other elements to the other side of said plane.

* * * * *